US010995752B2

(12) United States Patent
Kato et al.

(10) Patent No.: US 10,995,752 B2
(45) Date of Patent: May 4, 2021

(54) SCROLL-TYPE FLUID MACHINE

(71) Applicant: Hitachi Industrial Equipment Systems Co., Ltd., Tokyo (JP)

(72) Inventors: Fuminori Kato, Tokyo (JP); Katsushi Hidano, Tokyo (JP); Takanori Emi, Tokyo (JP)

(73) Assignee: Hitachi Industrial Equipment Systems Co., Ltd., Tokyo (JP)

( * ) Notice: Subject to any disclaimer, the term of this patent is extended or adjusted under 35 U.S.C. 154(b) by 299 days.

(21) Appl. No.: 16/083,974

(22) PCT Filed: Aug. 3, 2016

(86) PCT No.: PCT/JP2016/072718

§ 371 (c)(1),
(2) Date: Sep. 11, 2018

(87) PCT Pub. No.: WO2018/025338

PCT Pub. Date: Feb. 8, 2018

(65) Prior Publication Data

US 2020/0291939 A1 Sep. 17, 2020

(51) Int. Cl.
*F04C 18/02* (2006.01)
*F04C 29/04* (2006.01)

(52) U.S. Cl.
CPC ..... *F04C 18/0215* (2013.01); *F04C 18/0253* (2013.01); *F04C 29/04* (2013.01); *F04C 2240/30* (2013.01); *F04C 2240/40* (2013.01); *F04C 2240/50* (2013.01); *F04C 2240/603* (2013.01); *F04C 2240/805* (2013.01)

(58) Field of Classification Search
CPC .. F04C 18/0215; F04C 18/0253; F04C 29/04; F04C 2240/10; F04C 2240/50; F04C 2240/603; F04C 2240/30; F04C 2240/40; F04C 2240/805
See application file for complete search history.

(56) References Cited

U.S. PATENT DOCUMENTS 6,190,145 B1 * 2/2001 Fujioka ..... F04C 29/04 417/371
2010/0111740 A1 5/2010 Ni
(Continued)

FOREIGN PATENT DOCUMENTS

EP 0 994 258 A1 4/2000
EP 3 486 490 A1 5/2019
(Continued)

OTHER PUBLICATIONS

Extended European Search Report issued in counterpart European Application No. 16911599.5 dated Jan. 7, 2020 (eight pages).
(Continued)

*Primary Examiner* — Kenneth J Hansen
(74) *Attorney, Agent, or Firm* — Crowell & Moring LLP

(57) ABSTRACT

A scroll-type fluid machine is provided with a body unit having a fixed scroll and a turning scroll. Each of the fixed and turning scrolls include a lap formed on an end plate. The scroll-type fluid machine further includes a motor unit having a drive shaft for driving the body unit, rotors, and a stator. Cooling fins are formed on the opposite surfaces of the fixed scroll and the turning scroll from the surfaces of the respective end plates where the laps are formed.

9 Claims, 2 Drawing Sheets

(56) References Cited

U.S. PATENT DOCUMENTS

| | | | |
|---|---|---|---|
| 2015/0337834 | A1 | 11/2015 | Iwano et al. |
| 2019/0101115 | A1 | 4/2019 | Yamazaki et al. |

FOREIGN PATENT DOCUMENTS

| | | | | | |
|---|---|---|---|---|---|
| EP | 3486490 | | * | 5/2019 | ..... F04C 29/04 |
| EP | 3 492 743 | A1 | | 6/2019 | |
| JP | 2000-120568 | A | | 4/2000 | |
| JP | 2002-371977 | A | | 12/2002 | |
| JP | 2006-29238 | A | | 2/2006 | |
| JP | 2007-321563 | A | | 12/2007 | |
| JP | 2008-106694 | A | | 5/2008 | |
| JP | 2012-507659 | A | | 3/2012 | |
| JP | 2014-163333 | A | | 9/2014 | |

OTHER PUBLICATIONS

International Search Report (PCT/ISA/210) issued in PCT Application No. PCT/JP2016/072718 dated Nov. 1, 2016 with English translation (four pages).

Japanese-language Written Opinion (PCT/ISA/237) issued in PCT Application No. PCT/JP2016/072718 dated Nov. 1, 2016 (five pages).

International Preliminary Report on Patentability (PCT/IPEA/409 &PCT/IPEA/416) issued in PCT Application No. PCT/JP2016/072718 dated Sep. 22, 2017 (12 pages).

Japanese-language Office Action issued in Japanese Application No. 2018-531024 dated Apr. 7, 2020 with English translation (10 pages).

Japanese-language Office Action issued in counterpart Japanese Application No. 2018-531024 dated Aug. 20, 2019 with English translation (eight (8) pages).

* cited by examiner

SCROLL-TYPE FLUID MACHINE

TECHNICAL FIELD

The present invention relates to a scroll-type fluid machine.

BACKGROUND ART

In a compressor such as a scroll compressor, which is one type of scroll-type fluid machines, customer demand for space saving is high.

As a background art of this technical field, there is JP 2002-371977 A (Patent Document 1). Patent Document 1 discloses a scroll-type fluid machine in which a spiral compression operating chamber with a volume gradually decreasing from an outer circumferential side to an inner circumferential side with a revolution motion while preventing rotation of a turning scroll is partitioned between a fixed scroll and the turning scroll, and the incoming gas is transported, while compressing with the decrease in the volume of the compression operating chamber, in which the scroll-type fluid machine includes a turning bearing provided at one end of a main shaft, a motor side bearing provided at the other end of the main shaft, and a main bearing provided between the turning bearing and the motor side bearing, and at least a part of the turning bearing is located on a side closer to the fixed scroll than the end plate of the turning scroll.

CITATION LIST

Patent Document

Patent Document 1: JP 2002-371977 A

SUMMARY OF THE INVENTION

Problems to be Solved by the Invention

In Patent Document 1, the motor and a scroll compressor body are set to a direct-drive type, and a bearing position of the scroll compressor body is disposed on a compression chamber side to reduce a size in an axial direction. However, in a motor direct-drive type scroll compressor of such a structure, in some cases, since a radial dimension of the motor is only about a half of a radial dimension of the body, a cooling area of a motor unit decreases, and since no cooling fins are formed, no consideration is given to heat dissipation at all, and it is not possible to use the scroll compressor under a high load such as heat generation of the motor. As the cooling area of each part of a compressor body unit and the motor unit is reduced in this way in order to reduce the size, since the temperature rises and the part is not used as a product, it is necessary to consider each heat radiation.

In this regard, an object of the present invention is to provide a scroll-type fluid machine capable of reducing an axial length and reducing a size, without causing an imbalance between a compressor body unit and a motor unit in terms of dissipation of heat.

Solutions to Problems

In order to solve the above problem, the present invention provides, for example, a scroll-type fluid machine including: a body unit which has a fixed scroll having a lap formed on an end plate thereof, a turning scroll having a lap formed on an end plate thereof to face the lap of the fixed scroll, and a body casing which accommodates the fixed scroll and the turning scroll; and a motor unit which has a drive shaft connected to the body unit to drive the body unit, a rotor rotating integrally with the drive shaft, a stator which imparts a rotational force to the rotor, and a motor casing which accommodates the drive shaft, the rotor and the stator, in which a cooling fin is formed on a surface opposite to a surface on which the laps of the end plates of the fixed scroll and the turning scroll are formed, and when a radial dimension of the end plate of the fixed scroll is defined as $\alpha$, an axial dimension from a tip of the cooling fin of the fixed scroll to a tip of the cooling fin of the turning scroll is defined as lc, and an axial dimension of the stator is defined as ls, a relation of $\alpha/16+lc/4 \leq ls \leq \alpha/4+lc$ is satisfied.

Effects of the Invention

According to the present invention, it is possible to provide a scroll-type fluid machine capable of reducing an axial length without causing an imbalance between a body unit and a motor unit in terms of dissipation of heat.

MODE FOR CARRYING OUT THE INVENTION

Figure 1:
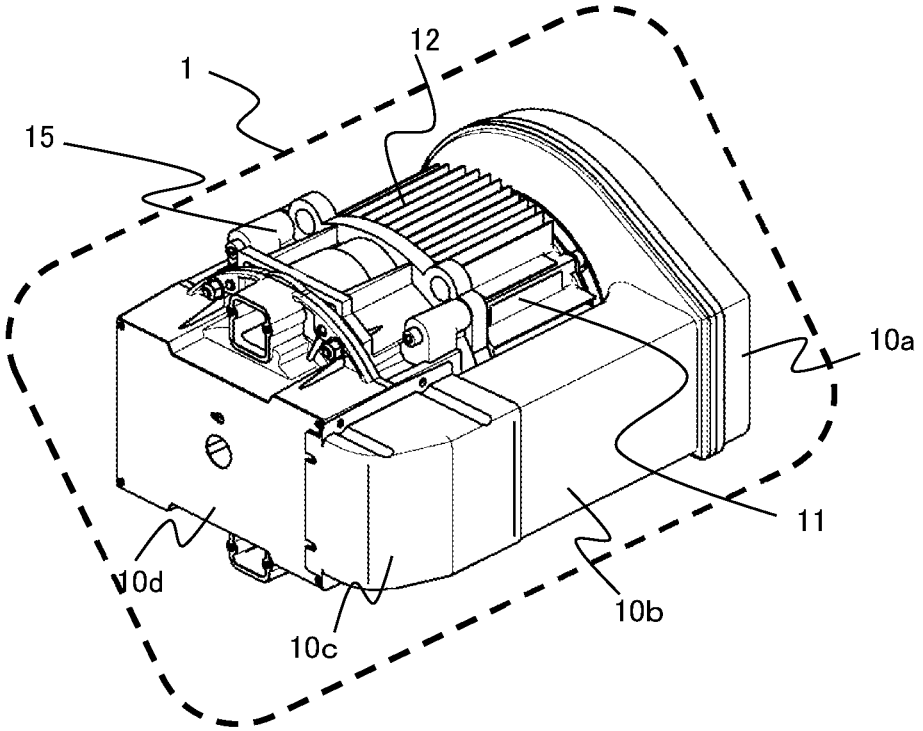
FIG. 1 is an external perspective view of a motor direct-drive type scroll compressor in an embodiment.

Embodiments of the present invention will be described below with reference to the drawings. Incidentally, in the drawings for describing the embodiments, elements having the same functions are denoted by the same names and reference numerals, and the repetitive description thereof will not be provided.

Embodiment

This embodiment will be described with reference to FIGS. 1, 2, 3, and 4. Incidentally, the present embodiment will be described by taking a motor direct-drive type scroll compressor which is one type of scroll-type fluid machines as an example.

FIG. 1 is an external perspective view of a motor direct-drive type scroll compressor 1 in this embodiment. In FIG. 1, the motor direct-drive type scroll compressor 1 mainly includes a body unit, and a motor unit for driving the same. The body unit has a body casing 15, a fixed scroll 7 to be described later, and a turning scroll 6 which is provided to face the fixed scroll 7 and makes a turning motion, and inflates or compresses the fluid. The motor unit has a shaft 3 and a motor casing 11 to be described later which are connected to the body unit and are drive shafts for driving the body unit, and a motor casing cooling fin 12 on an outer circumferential part of the motor casing 11. Furthermore, cooling air guiding members 10*a*, 10*b*, 10*c*, and 10*d* are provided for guiding cooling air generated by a cooling fin 8 to be described later and for cooling a turning scroll 6 and the fixed scroll 7, which will be described later.

Figure 2:
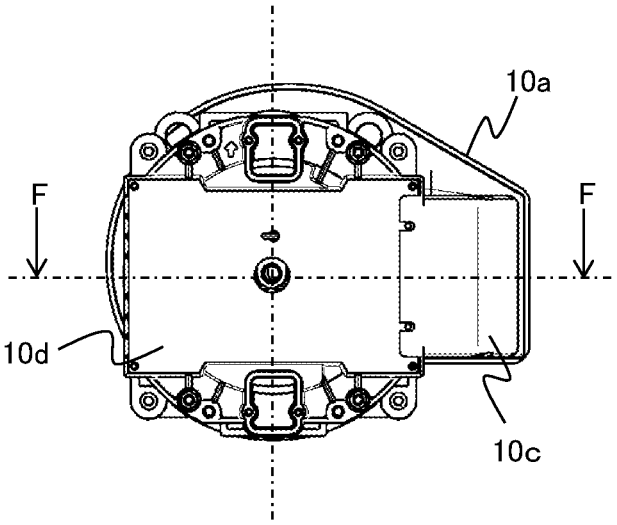
FIG. 2 is a front view of the motor direct-drive type scroll compressor in the embodiment.
Figure 3:
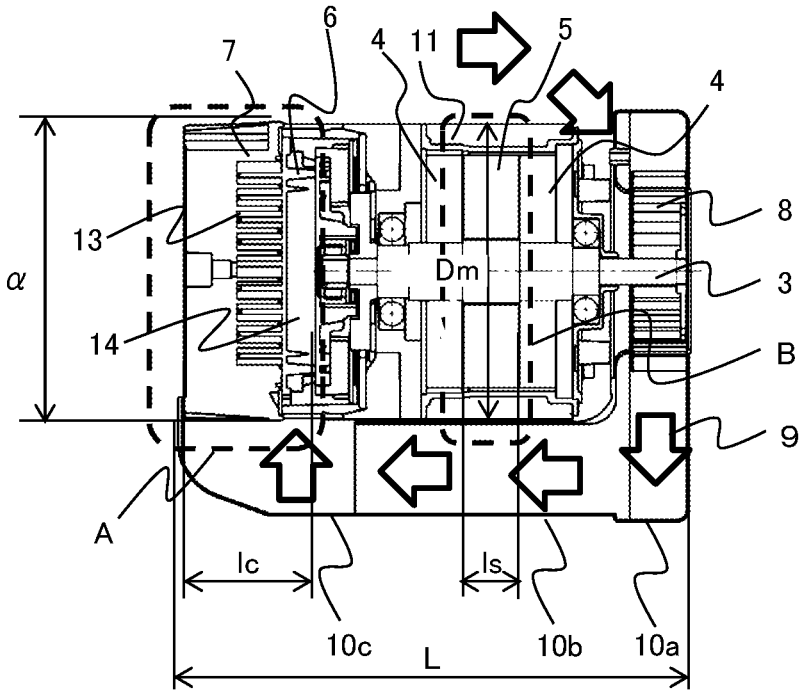
FIG. 3 is a cross-sectional view of the motor direct-drive type scroll compressor in the embodiment.
Figure 4:
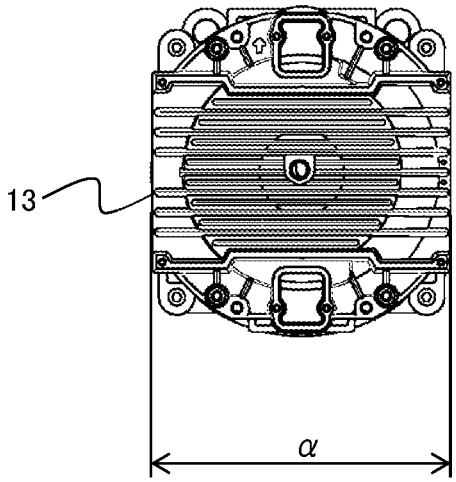
FIG. 4 is a front view of the motor direct-drive type scroll compressor in a state in which a cooling air guiding member is removed.

FIG. 2 is a front view of the motor direct-drive type scroll compressor 1, and FIG. 3 is a cross-sectional view taken from a position F-F of FIG. 2. FIG. 4 is a front view of a state in which the cooling air guiding member is detached, and illustrates a structural view of a fixed scroll cooling fin 13.

In FIG. 3, the shaft 3, a rotor 4 and the stator 5 of the motor direct-drive type scroll compressor 1 play a role of the motor, and by causing a current to flow through the stator 5, the rotor 4 and shaft 3 integrated with the rotor 4 turn. One end of the shaft 3 has an eccentric part which is a drive shaft for driving the turning scroll 6, and the turning scroll is assembled to the eccentric part. Further, the fixed scroll 7 is assembled to face the turning scroll 6, and the turning scroll 6 makes a turning motion with respect to the fixed scroll 7 by the rotation of the shaft 3. A spiral lap is provided on the end plate of the turning scroll 6 and the fixed scroll 7, and compresses the fluid by performing the aforementioned turning motion. In order to cool the stator 5 that generates heat to cause the flow of electric current, and the turning scroll 6 and the fixed scroll 7 that generate heat to compress fluid, a cooling fin 8 is provided at the other end of the eccentric part of the shaft. Cooling air guiding members 10*a*, 10*b*, 10*c*, and 10*d* for cooling the turning scroll 6 and the fixed scroll 7 by causing the cooling air to flow as illustrated by an arrow 9 are provided. That is, the outer circumferential surface of the motor unit is cooled by the cooling air flowing toward the cooling fin 8 from the body unit side, and the outer circumferential surface of the motor unit is cooled by the cooling air flowing from the cooling fin 8 toward the body unit side.

In order to improve the cooling efficiency, the motor casing cooling fin 12 illustrated in FIG. 1, and the fixed scroll cooling fin 13 and a turning scroll cooling fin 14 illustrated in FIG. 3 are provided on the outer circumferential portion of the motor casing 11 for holding the stator 5, the fixed scroll 7 and the turning scroll 6.

Further, a turning bearing that supports the drive shaft with respect to the turning scroll 6 is disposed on a side closer to the motor unit than the end plate of the turning scroll 6. As a result, compared with a shape in which the turning bearing enters into the end plate in order to reduce the axial dimension, even with the turning scroll 6 and the fixed scroll 7 having the same diameter, a compression amount can be secured without reducing a compression chamber.

In addition, the rotor 4 and the stator 5 are configured to face each other in the axial direction. As a result, the axial dimension can be reduced.

Further, the body unit and the motor unit are attachably and detachably fastened between the body casing 15 and the motor casing 11 by a fastening member.

Further, by making the radial dimension of the motor casing 11 longer than the axial dimension, it is possible to reduce the axial dimension, and at the same time, to secure the cooling area.

Here, in a case where cooling parts of the turning scroll 6, the fixed scroll 7 and the stator 5, which are heating elements, are approximated to a cylinder, when an effective cooling area of a region A indicated by a dotted line and formed by the laps of the fixed scroll 7 and the turning scroll 6 and the cooling fins 13 and 14 is defined as $S_A$ and an effective cooling area of a region B indicated by a dotted line and formed only by the stator 5 and a fitting portion of the motor casing 11 with the stator 5 is defined as $S_B$, $S_A$ and $S_B$ can be approximated by formulas (1) and (2).

$S_A$=end plate surface area of fixed and turning scrolls+cylinder side area of fixed and turning scrolls=$2\pi\times(\alpha/2)^2+2\pi(\alpha/2)\times lc=\pi\alpha^2/2+\pi\alpha lc$ (1)

$S_B$=motor casing stator unit cylindrical side area=$\pi Dmls$ (2)

Here, α: a horizontal dimension (a radial dimension of the end plate of the fixed scroll) of the fixed scroll cooling fin 13 with respect to the cooling air, lc: a distance from the end surface of the turning scroll cooling fin 14 to the end surface of the fixed scroll cooling fin 13, Dm: a radial dimension of the motor casing (including cooling fin), and ls: an axial dimension of the stator.

Furthermore, the motor direct-drive type scroll compressor generally has a motor efficiency higher than efficiency of the compressor body. An amount obtained by subtracting the efficiency component from input power is set as a loss, and since respective losses are proportional to respective heat generation amounts, the heat generation amount of the compressor body becomes greater than the heat generation amount of the motor. Here, in the motor direct-drive type scroll compressor of the present embodiment, since heat generation amounts Qc of the fixed scroll and the turning scroll are 10 to 40% with respect to the input of the motor, and a heat generation amount Qs of the stator is about is 10% with respect to the input of the motor, a relational formula between Qs and Qc has a relation of formula (3).

$$Qc/4\leq Qs\leq Qc \quad (3)$$

In order to prevent heat dissipation between the body unit and the motor unit from becoming imbalanced, it is necessary to provide an area corresponding to formula (3), and thus the relation between $S_A$ and $S_B$ is set to a relation of formula (4).

$$SA/4\leq SB\leq SA \quad (4)$$

Therefore, the following formula (5) is derived from the formulas (1), (2) and (4).

$$\alpha^2/8+\alpha lc/4\leq Dmls\leq\alpha^2/2+\alpha lc \quad (5)$$

Here, the relation between α and Dm will be described. In the case of α>Dm, since a cooling air passage is complicated or the passage length needs to be lengthened, the pressure loss of the cooling air increases, the air flow rate decreases, and the cooling of the turning scroll and the fixed scroll deteriorates. Also, since Dm is reduced, is increases and an overall axial dimension L increases. On the other hand, in the case of α<Dm, since the cooling air is difficult to flow to the motor casing 11, the motor cooling deteriorates. Further, since the motor casing is large, it is necessary to adopt a structure of a cooling air guiding member to avoid this. As a result, the cooling air guiding member has a complicated shape, the pressure loss increases, and the cooling air volume decreases. For the above reasons, the relation between α and Dm is set to the relation of formula (6).

$$\alpha=Dm \quad (6)$$

Since the approximation of formula (6) is established, the tip of the cooling fin of the motor casing is at least outside the outermost circumferential surface of the lap formed on the fixed scroll.

Using formula (6), formula (5) becomes formula (7).

$$\alpha/8+lc/4\leq ls\leq\alpha/2+lc \quad (7)$$

Therefore, in the present embodiment, by setting α, lc, and ls to satisfy the formula (7), it is possible to provide a motor direct-drive type scroll compressor capable of equalizing the heat dissipation of the body unit and the motor unit and reducing the axial length. Therefore, miniaturization and temperature reduction of the motor direct-drive type scroll compressor can be attained at the same time, resulting in a customer merit.

The present invention is not limited to the embodiments described above, but includes various modified examples. For example, although the scroll compressor has been described in the above embodiment, it may be, for example, a blower, a pump or the like other than the compressor, and may be a so-called scroll-type fluid machine. Furthermore, the above-described embodiments have been described in detail in order to explain the present invention in an easy-to-understand manner, and are not necessarily limited to those having all the configurations described.

REFERENCE SIGNS LIST

1 Motor direct-drive type scroll compressor
3 Shaft
4 Rotor
5 Stator
6 Turning scroll
7 Fixed scroll
8 Cooling fin
9 Cooling air flow direction
10*a*, 10*b*, 10*c*, 10*d* Cooling air guiding member
11 Motor casing
12 Motor casing cooling fin
13 Fixed scroll cooling fin
14 Turning scroll cooling fin
15 Body casing
α Cooling air flow including cooling fins and horizontal dimension
lc Distance from end surface of fixed scroll cooling fin to end surface of turning scroll cooling fin
Dm Radial dimension of motor casing (including cooling fin)
ls Axial dimension of stator
L Axial dimension of motor direct-type scroll compressor

The invention claimed is:

1. A fluid machine comprising:

a body unit which has a fixed scroll having a lap formed on an end plate thereof, a turning scroll having a lap formed on an end plate thereof to face the lap of the fixed scroll, and a body casing which accommodates the fixed scroll and the turning scroll; and a motor unit which has a drive shaft connected to the body unit to drive the body unit, a rotor rotating integrally with the drive shaft, a stator which imparts a rotational force to the rotor, and a motor casing which accommodates the drive shaft, the rotor and the stator, a first cooling fin formed on a surface opposite to a surface on which the lap of the end plate is formed;

a second cooling fin formed on the fixed scroll; and a third cooling fin formed on the turning scroll, wherein a heat generation amount of the fixed scroll and the turning scroll are defined as Qc, a heat generation amount of the stator is defined as Qs, and $Qc/4 \leq Qs \leq Qc$ is satisfied; and a radial dimension of the end plate of the fixed scroll is defined as α, an axial dimension from a tip of the second cooling fin of the fixed scroll to a tip of the third cooling fin of the turning scroll is defined as lc, a radial dimension of the motor casing is defined as Dm, an axial dimension of the stator is defined as ls, and $\alpha/8+lc/4 \leq ls \leq \alpha/2+lc$ is satisfied under the condition of $\alpha=Dm$.

2. The fluid machine according to claim 1, further comprising:

a forth cooling fin formed on an outer side in a radial direction of the motor casing, and the tip of the fourth cooling fin of the motor casing is disposed on the outer side in the radial direction than an outermost circumferential surface of the lap formed on the fixed scroll.

3. The fluid machine according to claim 1, wherein a turning bearing configured to support the drive shaft with respect to the turning scroll is disposed on a side closer to the motor unit than the end plate of the turning scroll.

4. The fluid machine according to claim 1, further comprising:

a fifth cooling fin provided at an end portion of the drive shaft opposite to the body unit.

5. The fluid machine according to claim 4, wherein an outer circumferential surface of the motor unit is cooled by cooling air flowing from the body unit side to the fifth cooling fin.

6. The fluid machine according to claim 4, wherein an outer circumferential surface of the motor unit is cooled by cooling air flowing from the fifth cooling fin to the body unit side.

7. The fluid machine according to claim 1, wherein the rotor and the stator are axially opposed to each other.

8. The fluid machine according to claim 1, wherein the body unit and the motor unit are attachably and detachably fastened between the body casing and the motor casing by a fastening member.

9. The fluid machine according to claim 1, wherein a radial dimension of the motor casing is longer than the axial dimension.

* * * * *